United States Patent [19]

Romano

[11] Patent Number: 4,655,150

[45] Date of Patent: Apr. 7, 1987

[54] DEVICE FOR ALIGNING CONTOURS OF FABRICS FOR INDUSTRIAL SEWING MACHINES

[76] Inventor: Antonino Romano, via Chiesa Nuova 22, 03039 Sora (FR), Italy

[21] Appl. No.: 871,404

[22] PCT Filed: Aug. 28, 1985

[86] PCT No.: PCT/IT85/00030

§ 371 Date: Apr. 29, 1986

§ 102(e) Date: Apr. 29, 1986

[87] PCT Pub. No.: WO86/01546

PCT Pub. Date: Mar. 13, 1986

[51] Int. Cl.[4] ..... D05B 35/10

[52] U.S. Cl. ..... 112/153; 112/308; 112/DIG. 2

[58] Field of Search ..... 112/153, 152, 136, 308, 112/309, DIG. 2, DIG. 3

[56] References Cited

U.S. PATENT DOCUMENTS

| | | | |
|---|---|---|---|
| 3,782,310 | 1/1974 | Stockel . | |
| 3,794,230 | 2/1974 | Bryan et al. . | |
| 3,905,316 | 9/1975 | Mall . | |
| 4,019,448 | 4/1977 | Marforio . | |
| 4,067,271 | 1/1978 | Angele et al. . | |
| 4,133,279 | 1/1979 | Wajcmann . | |
| 4,307,676 | 12/1981 | Avesani et al. | 112/153 |
| 4,590,876 | 5/1986 | Mencke et al. | 112/153 X |

FOREIGN PATENT DOCUMENTS

| | | | |
|---|---|---|---|
| 2632366 | 1/1978 | Fed. Rep. of Germany . | |
| 3240409 | 9/1983 | Fed. Rep. of Germany . | |
| 765429 | 9/1980 | U.S.S.R. | 112/153 |

*Primary Examiner*—H. Hampton Hunter

*Attorney, Agent, or Firm*—Stevens, Davis, Miller & Mosher

[57] ABSTRACT

Device for aligning automatically the contours of two plies to be sewed one upon the other, consisting of three superimposed blades (1,2,3) hinged to one another at one end by means of a cross pin (4) so as to generally form a double pliers. From the pin (4) onwards the device comprises :elastic means (7) which can be calibrated and tending to press the blade (2) against the blade (1) and the blade (3) against the blade (2); means (8) to vary the angular opening between the blades (1,2,3), means (9) to adjust the maximum and minimum angular opening between the blades (1,2,3), abuting means (**28*a*,28*b*,28*c***) to define the alignment position of the contours of the plies (T,t) to be sewed and means to bring the plies to the alignment on an air pad or by friction.

20 Claims, 9 Drawing Figures

FIG. 1a
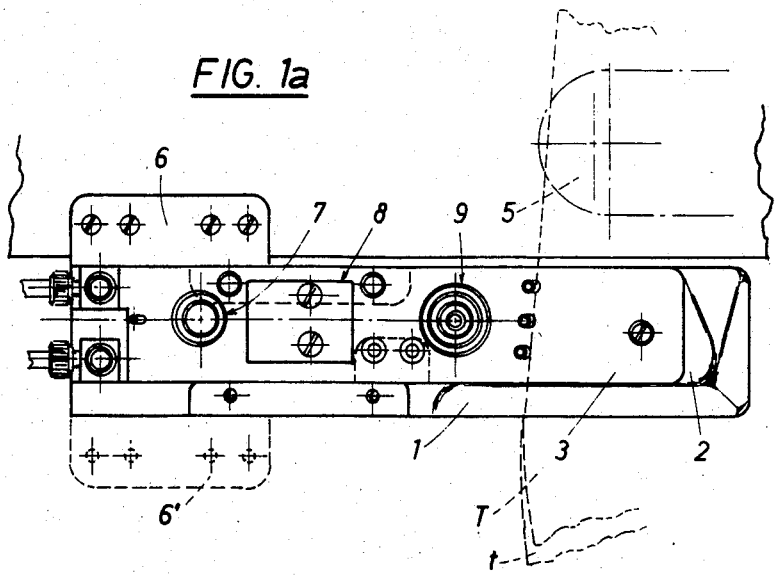
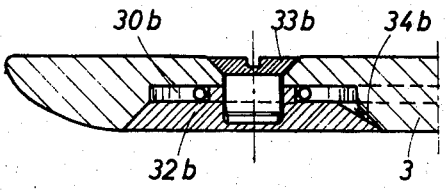
FIG. 7a
FIG. 7b
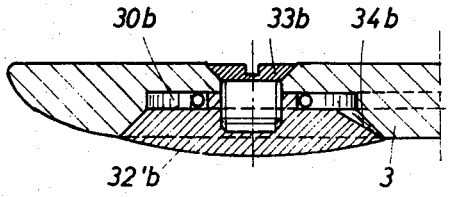

DEVICE FOR ALIGNING CONTOURS OF FABRICS FOR INDUSTRIAL SEWING MACHINES

The present invention relates to a device for the automatic alignment of the contours of plies to be conveyed one upon the other to the sewing station where they are sewed on one another. The device can be also used to guide only one ply towards the sewing station, for example, when the sewing of an edge, an embroidery or the like has to be made. The device according to the present invention is designed to have the function of essential fitting for industrial sewing machines because it produces considerable advantages in the sewing industry as far as both the quality of the hand-made goods and the productivity are concerned and also for the presence of a new aligning system. Some devices and appliances designed to this end are already know. However, they generally are integral with mechanic sewing machines which are very complicated.

Furthermore they have poor adaptability to the various kind of processing or manufacture and are provided with complicated control means and aligning means which do not assure an optimum result for every kind of goods to be sewed.

The present invention seeks to obviate the above mentioned inconveniences by means of a device that besides being of simple construction and convenient operation assures a better result regardless of the material characteristics.

Another aim of the present invention is that of providing a device operating as an universal guide which aligns the contours of plies and is applicable to the most dissimilar sewing machines.

The device of the invention is of easy use, not very cumbersome, accurate and designed to be included in and excluded from the processing.

The device according to the present invention consists essentially of three superimposed, generally rectangular blades which are hinged at one end and have the form of a double pliers, the three suitably shaped blades engaging in pairs two plies to be sewed together and guiding the contours thereof so that said contours are parallel and laid one upon the other. From the end where the hinge pin is places onwards the device comprises spring means which can be calibrated and are able to push the middle blade against the lower blade, and the upper blade against the middle blade. It is also possible to provide elastic means to oppose the weight of the blades.

The application area of the elastic force pushing the blades towards one another is near the hinge axis because the edges of the fabric have to travel almost without friction between the respective pairs of blades. The engaging area of the blades i.e. the operation area of the guides, is formed by the end of the three blades which is opposite to the hinge axis, said area being provided, as shown later on, with means to make the alignment easier and being limited by abuting means against which the plies to be aligned are beating. In the device, after the above mentioned elastic means a mechanism is provided which is able to oppose the action of said elastic means causing the opening of the blades so as to make the initial insertion of the plies to be aligned and sewed easier and causing then their closing up to the position of the selected calibration which is carried out by means of controlling the maximum and minimum opening angle of the blades under working condition.

The contours of the plies are inserted so that the upper contour enters between the upper blade and the middle one, while the lower contour enters between the middle blade and the lower one.

To better intend the features and the advantages of the present invention a preferred non-limitative embodiment and some variants thereof are described with reference to the accompanying drawings, wherein:

FIG. 1 is a top view of the device according to the preferred embodiment of the present invention;

FIG. 1*a* is the spread out flat view of FIG. 1,

FIGS. 7*a* and 7*b* show the sections of the ejecting means.

Figure 1:
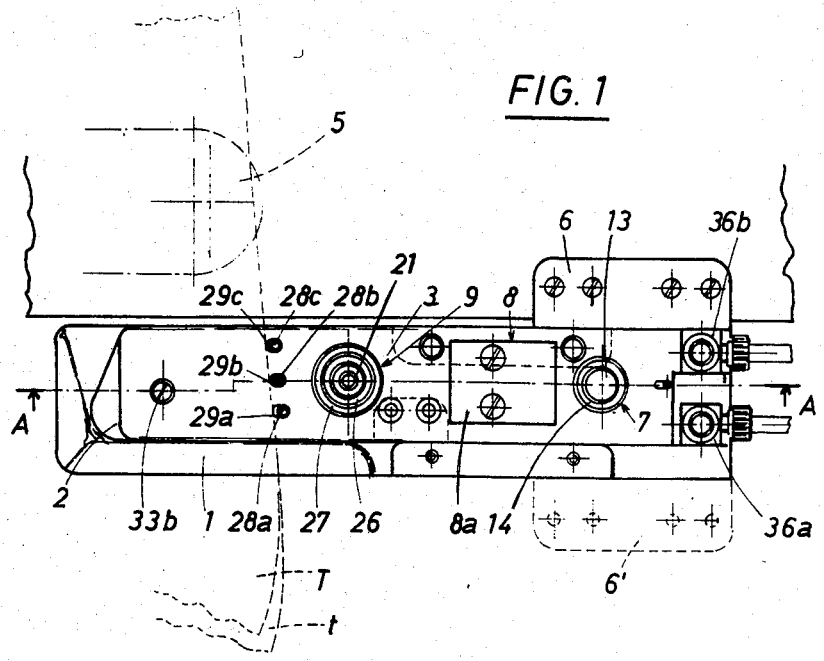
Figure 2:
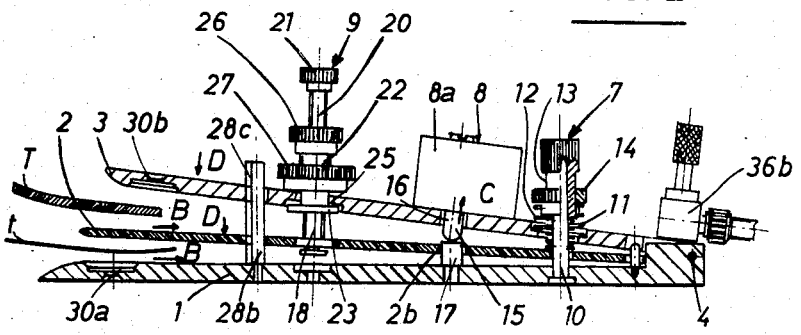
FIG. 2 is the longitudinal section of the device taken along the broken line A—A of FIG. 1 and showing the device under preliminary condition before the operation.

With reference to the figures, in particular to FIGS. 1 and 2, the device for aligning the contours of the plies to be laid one upon the other and sewed together according to a preferred embodimend of the invention consists of three superimposed generally rectangular blades, the lower blade of which is designated by 1, the middle blade by 2 and the upper blade by 3. The blades preferably made of a metallic alloy and suitably shaped are hinged to one another at one end about a transversal pin 4 (FIGS. 2 and 3) and form essentially a double pliers.

The assembly of the three blades 1, 2, 3 of this alignment device is mounted upstream and near the sewing station 5 of an industrial sewing machine. The assembling can be effected by means of a connecting bracket 6 or the like placed at choice on one of the sides of said device. By way of example reference is made to the bracket 6' of FIG. 1. The bracket 6, 6' can connect directly the lower blade 1 to the sewing machine (FIG. 1) or alternatively it can be fastened to the machine by other supporting means allowing the alignment device to be put and maintained in working conditions or to be put away from the processing by means of a rotation or a translation.

Referring to the FIGS. 1 and 2 and beginning from the hinge pin and proceeding from right to the left-hand side said device comprises: adjustable pressure means generally designated by 7, means for spacing out the blades generally designated by 8, means for controlling the opening angles between the blades generally designated by 9; and finally abuting and guiding means enabling the contours of the plies to be aligned and sewed together.

The adjustable pressure means 7 are arranged to push independently the middle blade 2 against the lower blade 1 and the upper blade 3 against the middle blade 2.

To this end a vertical, threaded pin 10 is provided which is fastened in a seat formed in the lower blade 1 and passes f through large holes formed in the blades 2 and 3, respectively said large holes allowing said pin 10 to freely pass through during the angular motion of the blades 2 and 3 with respect to the blade 1. Two helical springs 11 and 12 are coaxially mounted about the pin 10: the spring 11 has a diameter lower than the inner diameter of the spring 12 and has an axial height such as to abut against the middle blade 2 and the lower end of a hollow pin 13 which can be screwed about the pin 10 through its knurled head 13*a*. The hollow pin 13 is threaded also outside so that the threaded ring nut 14 can be screwed about it in order to counteract the spring 12 which is acting outside the spring 11 in the space defined by the blade 3 and the ring nut. In such a position the springs 11 and 12 generate an adjustable load force which is independent in each passage way. The piston means 8 allows an adjustable opening of the blades 1, 2, and 2, 3 to be obtained in order to enable the initial insertion of the contours of the plies T and t to be sewed in the guiding means.

From the piston means 8 electrically or pneumatically driven and locked in place on the upper surface of the plate 3 a piston 15 comes out when the piston means is activated and passes through a hole formed in the blade 3 so that is abuts against the head of an abutment pin 17 fastened at an adjustable height to the lower blade 1. When the piston 15 is retracted the blades 1, 2, 3 are allowed to approach each other according to the respective adjusted positions prefixed by the controller 9 under the influence of the return springs 11 and 12.

Figure 4:
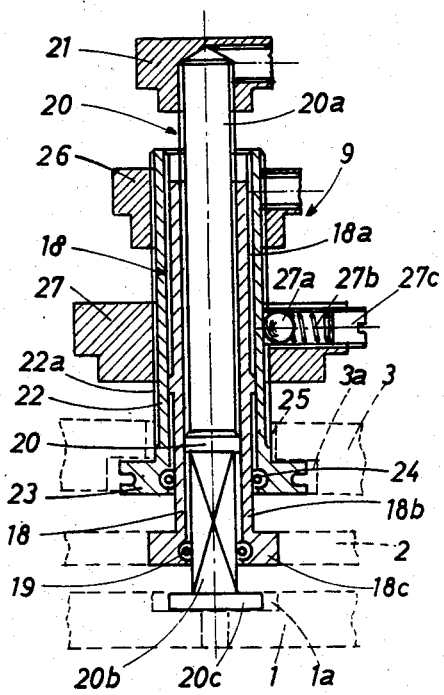
FIG. 4 is a partial section in enlarged scale of the means for controlling the opening angles between the blades of the device.
Figure 5:
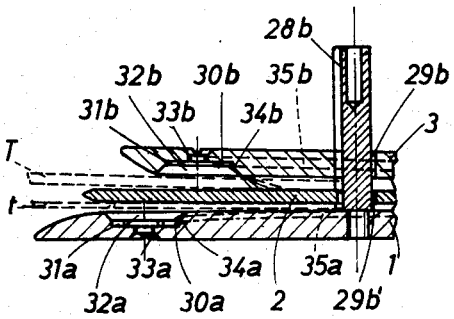
FIG. 5 shows in enlarged scale and in greater detail the particular of the engaging area and the engaging means of the plies to carry out and make easier the alignment of the contours shown in FIG. 2.
Figure 6:
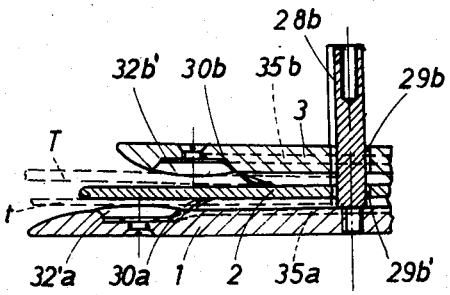
FIG. 6 is a section similar to that of FIG. 5 but concerning a modification of the engaging means for the alignment of the contours of the plies.

The means 9 for controlling the opening angles of the blades, which can be better seen in FIG. 4, has the function of adjusting the angular spacing between the blades 1, 2 and 2, 3 under working conditions and the maximum angular spacing under preliminary conditions before starting the operation.

The controlling means 9 comprises: a vertical sleeve means 18 having an upper portion 18*a* with cylindrical external and internal surface which are both threaded with a very little pitch and a lower portion 18*b* with prismatic external surface and cylindrical internal surface. The sleeve 18 becomes larger downwards and terminates in an external flange 18*c* locked in place in a through hole formed in the middle blade 2. At the lower end of the sleeve 18 and at height of the flange 18*c* recesses are formed in the internal surface for receiving a wire spring 19, the function of which is that of pressing the flat surfaces of the prismatic end of a pin 20 which is inside and coaxial to the sleeve 18 in order to hinder the rotation thereof after its micrometric adjustment which can be carried out according to split turns. The upper portion 20*a* of the pin 20 is threaded outside with a pitch similar or equal to that of the inside thread of the sleeve 18. The pin 20 terminates at the lower end in a circular head 20*c* which abuts against a recess 1*a* formed in the upper surface of the blade 1, so that the adjustment of the angular opening of the blades 1 and 2 can be provided by the rotation of the ring nut 21 which is integral with the other end thereof.

About the sleeve means 18 another sleeve 22 is assembled which is threaded inside and outside and the lower end thereof is widen out forming a flange 23 which is housed in an upper recess 3*a* axially aligned with the hole 25 formed in the upper blade 3 in order to allow the blades to perfectly adhere to one another. When acting on the ring nut 26 integral with the upper end of the pin 22 the adjustment of the angular opening of the blades 2 and 3 can be provided due to the raising of the blade 3 with respect to the blade 2. The flange 23 is provided in the internal surface with recesses simmetrical with respect to the sleeve axis for receiving a wire spring 24 similar to that of the sleeve 18 and having the same function.

The external diameter of the flange 23 is then such as not to allow it to pass through the hole 25 which is formed in the upper blade 3 for receiving the sleeve 22 and is coaxial to the hole 2*a* receiving the sleeve 18 and formed in the middle blade 2.

A threaded and knurled ring nut 27 establishing the position of the middle blade 2 with respect to the blades 1 and 3 is mounted about and is freely travelling along the sleeve 22, said ring nut 27 having the external diameter larger than that of the hole 25 and engaging by friction the threaded surface 22*a* with a ball 27*a* thrust by a spring 27*b* subjected to the action of a screw 27*c* for calibrating the friction. It is self evident that the rotation of the knurled nut 21 if the pin 20 causes the axial translation of the latter within the sleeve 18 which is made integral with the middle blade 2 and then when the piston means is not operating it is possible to adjust the angular opening under working conditions of the middle blade 2 with respect to the lower blade 1 because the pin 20 abuts against the base blade 1. The adjustment can be effected with high precision due to the very little pitch of the screw threads and also because it is performed according to split turns of the pin 20 what is possible due to the spring 19 acting on the prismatic portion 20*b* of the pin 20 which is allowed to rotate only step by step.

In the same way it is possible to adjust the angular opening under working conditions between the middle blade 2 and the upper blade 2 by acting on the middle knurled ring nut 26 locked in place at the top of the sleeve 22. In this case it is the flange 23 that supports the upper blade 3 aising against the action of the spring 12 of the pressure means 7 which acts with its spring 11 on the middle blade 2 too.

Also the upper plate 3 is adjusted by split turns of the sleeve 22 due to the action of the spring 24 that presses the flat surface of the prismatic end 18b of the sleeve 18 in order to adjust the maximum angular opening between the blades 1, 2 and 2, 3, respectively, when the piston means is operating, i.e. under preliminary conditions, it is sufficient to displace the knurled ring nut 27 along the sleeve 22 up to the desired point. If for example it is assumed that the piston 15 of the spacing means 8 comes out slowly, the consequent raising of the upper blade will not cause a displacement of the middle blade till the upper blade 3 comes in touch with the knurled ring nut 27. If the blade 3 goes on raising the ring nut 27 trails the middle blade 2 that will depart progressive away from the base blade 1 up to the end of the stroke of the piston 15 and till reaching the predetermined position. The receiving and aligning areas of the contours of fabrics to be aligned and sewed are formed by the front portions of both inner surfaces of the upper blade 3 and of the lower blade 1, respectively, and of both opposed surfaces of the middle blade 2, as shown in the FIGS. 1, 2, 3, 5 and 6 on the left-hand side of the controller 9. Said areas are delimited inwardly by three vertical, cylindrical pegs 28*a*, 28*b*, 28*c* against which the contours of the plies to be aligned are beating. Such pegs are fastened to the base blade 1 and pass through the other blades 2 and 3 in openings 29*a*, 29*b*, 29*c* and 29'*a*, 29'*b*, 29'*c* which are large enough so as not to hinder the angular displacement of the blades 2 and 3 away from the blade 1.

One said pegs 28*a*, 28*b*, 28*c*, if that is the case for further automation, sensors (for example photocells schematically shown dashed in FIG. 3) can be provided which are adapted to sense automatically the presence of the plies in the device of the invention. In another embodiment of the invention besides the assembly of abuting pegs 28*a*, 28*b*, 28*c* already described a second assembly of pegs is provided which are fastened to the blade 2 and are placed parallel to the first assembly. This in order to provide the offset alignment of the contours. A means is provided to make easier the travelling of the contours of fabric towards the abuting pegs 28*a*, 28*b*, 28*c* and then the alignment thereof in the area for receiving and aligning the contours of the plies and in particular on the upper blade 3 and the lower one 1 near the free ends thereof which are tapered in order to provide a surface making easier the entry of the fabric plies T and t. According to a first embodiment shown in FIG. 5 said means comprises two ejectors able to emit fanlike sprays of compressed air which can be oriented, said ejectors being formed by plates 32 locked in their respective seats.

To this end in both upper and lower blades 3 and 1, respectively, cylindrical seats 31*b*, 31*a* are provided having frustum-conical sections towards the inner surface of the blades. The plates 32*a*, 32*b*, are housed in said seats and mate with the frusto-conical section of the seats, thus providing a sealing except for a certain arc, for example 60°, of the extension thereof, the shape of the plates providing also a through hole 34*a*, 34*b* which is used as ejector of the compressed air incoming through a duct 35*a*, 35*b* to the chambers provided under the plates. The air is supplied by a compressed air source (not shown) through eventual flow controlling valves 36*a*, 36*b* (FIG. 1) placed upstream of the ducts 35*a*, 35*b*. The compressed air provides a swirling jet coming out of the seat and the respective plate tangentially thus forming an air pad in the desired direction which is able to align the plies. A modification of the aligning means provides plates 32'*a*, 32'*b* having a convex surface engaging the ply and identical features as the previous plates as far as the compressed air ejectors are concerned, such plates being also able to engage the ply by friction, as described later on.

Figure 3:
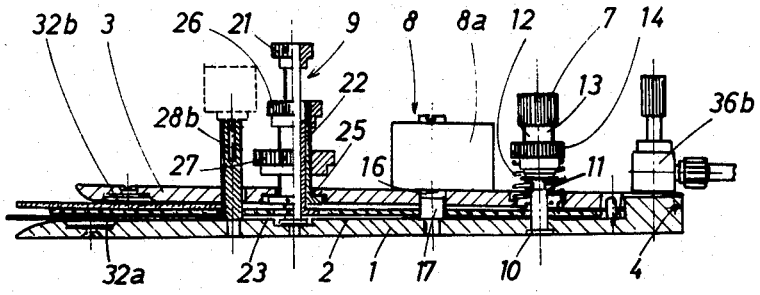
FIG. 3 is a section similar to the previous one but showing the device under working condition.

The operation of the device for aligning the contours of the plies to be laid one upon the other and sewed according to the present invention is as follows:

It is assumed that the device is already installed in the processing line near the sewing station 5, as shown in FIG. 1. The operator activates the piston means 8 so that the device can take the position shown in FIG. 2. By acting on the larger ring nut 27 of the means 9 controlling the angular opening of the blades, the most convenient angular openings of the blades are selected to make easier the insertion of the plies T and t, the contours of which have to be laid one upon the other and aligned to be then sewed. The direction of insertion is indicated by the arrows B in FIG. 2, in which T designates a fabric of higher thickness and consistency with respect to a second fabric t which could be a lining, thus showing how the device of the invention can process indifferently materials of different thickness. The piston means 8 is then deactivated. This piston 15 returns in its housing 8*a* in the direction indicated by the arrow C in FIG. 2 and the blade 2 and 3 are lowered in the direction of the arrow D in order to provide a passage way having a suitable thickness for the material to be sewed. The new position of the device is shown in FIG. 3. The counteracting springs 11 and 12 of the pressure means 7 are suitably adjusted according above all to the maximum thickness of the contours of the plies designed for travelling between the blades 1, 2, 3, wherein said thickness can depend besides on the actual consistency of the fabrics also on already existing folds or seams.

In such a way it is selected the minimum gap which has to be granted between the blades in the receiving and aligning area according to the thickness of the fabrics. The plies T and t of fabrics have to be supplied so as to be able to travel by a greatly reduced friction in order not to brake too much the action of the feeding equipment of the sewing machine. The gaps between the middle blade 2 and the lower one 1, and between the upper blade 3 and the middle one 2 are selected by means of the smaller ring nut 21 and the middle one 26 of controller 9, respectively operating as already described and illustrated. When the suitable gaps are selected the means to make the alignment easier can be activated and the sewing operation can be started.

If the means to make the alignment easier is the compressed air means, the plates 32*a*, 32*b* are suitably oriented so that the action of the compressed air is tending to bring the contours of the fabric plies against the abuting means 28*a*, 28*b*, 28*c*. The advantage of swinging the plates is that a perfect alignment is provided under different operating conditions due to the various materials involved. By way of example, when the air jet is directed so as to collide besides with the aligning assembly also with the area of the operator, the unfolding of the fabrics tending to crumple up is provided, and when the air jet is directed so as to collide besides with the aligning assembly also with the area opposite to the above mentioned one, a better condition of certain kinds of fabric and a certain cooling of the needle of the sewing machine are provided. The compressed air flow regulating valves 36*a*, 36*b* have to be controlled so as not to cause too strong jets which could curl the fabrics.

A further advantage of the present invention is the possibility of replacing the flat plates of the present invention with convex plates 32'*b* and 32'*a* because by the adjustment of the elastic load of the springs 11 and 12 of the pressure means 7 it is possible to provide engaging areas on the plates causing the plies to be deviated so as to be directed towards the abuting means, thus providing the alignment. To this end the abuting means 28*a*, 28*b*, 28*c* have their axis laying in a vertical plane which is inclined by a small angle with respect to the sewing station 5 and to the plane crossing the plane passing through the longitudinal axis of the means 7 and 9, as shown in FIG. 1.

When the contours of the fabrics to be sewed have gone beyond the device of the invention, the already described control operations have to be repeated in order to insert next plies unless the kinds and the features of the plies of fabrics remain the same.

It is to be added that even two plies at the time can be passed between a pair of blades, in this case also the middle blade 2 is provided with a compressed air system making the alignment of the innermost ply easier. It is also to point out that, when two plies having features very different from each other have to be sewed together, for example a somewhat slippery material between the blades 3 and 2 and a coarse material between the blades 2 and 1, both embodiment of the means making the alignment easier can be provided in the device of the invention, for example the compressed air means on the blade 1 and the friction means on the blade 3.

According to another embodiment of the invention the blades of the device can be four so as to sew three plies at the same time.

The device according to the invention illustrated in the figures allows the right-hand side of the plies with respect to the operator to be aligned and then sewed. It is self evident that in case of particular requirement it is possible to provide a device which is specular to that described herein, i.e. such that alignment of the left-hand side of the plies with respect to the operator is provided. In particular such a device is shown in FIG. 1*a*.

I claim:

1. Device for aligning the contours of two plies for industrial sewing machines, characterized by that it comprises three generally rectangular shaped blades (1, 2, 3) laid one upon the other and hinged at one end to a transversal hinge pin (4) and arranged like a double pliers, wherein the lower blade (1) is supported near a sewing station (5) by a connecting bracket (6) to be fastened to a supporting means of said machine between the hinge area of said hinge pin (4) and the opposite end where a receiving area of the plies of fabric (t, T) is provided, following means being provided after one another from the hinge pin (4) of the blades (1, 2, 3) onwards:

return spring means (7) of the adjustable type to bring back the blades under working conditions and to press them against the lower blade (1);

means (8) opposing the action of the return spring means (7) in order to bring the blades (1, 2, 3) from the preliminary condition to the working position, thus allowing the insertion of the plies;

angular opening controlling means (9) acting on the blades (1, 2, 3) both in the preliminary and working conditions;

abuting means (28*a*, 28*b*, 28*c*) for defining the aligning position of both plies; and means to make the insertion of the contours and their alignment easier so that after the adjustment of said means according to the requirements of the plies to be sewed and to the processing conditions and after having activated the angular opening means and having inserted in the receiving area the contours of the plies to be sewed together, the angular opening means is deactivated and the aligning means is activated to automatically align the contours of the plies to be sewed to each other so that the contour of one ply is laid upon the contour of the second ply and both plies can successively reach the sewing station generally parallel to each other.

2. Device according to claim 1, wherein said means (7) are:

(a) a vertical threaded pin (10) provided with an engaging head (13*a*) protruding upwards from the blade (1) and fastened to said blade, (b) a sleeve (13) threaded inside and outside and screwed about the pin (10), said sleeve pressing against the blade (2) by means of a spring (11) and crossing the blade (3); (c) a ring nut (14) screwed about the sleeve (13) and designated so as to abut against a spring (12) placed outside the spring (11) thus pressing the blade (3), so that the load of the spring (11) can be adjusted by the rotation caused by the head (13*a*) of the sleeve (13) and the load of the spring (12) can be adjusted by means of the ring nut (14).

3. Device according to claim 1, wherein a piston (15) which preferably is pneumatically driven can come out of the casing (8*a*) passing through a hole (16) of the blade (3) and presses the head of a vertical pin (17) protruding from the upper surface of the blade (1) and having adjustable height.

4. Device according to claim 1, wherein the means (9) for the adjustment of the angular opening of the blade (1, 2, 3) is:

a vertical cylindrical pin (20) which is threaded outside at its upper and middle sections (20*a*) and is prismatic at its lower section (20*b*), said pin being widen out at said lower section in a base plate (20*c*) to be inserted in a seat (1*a*) opened towards the upper surface of the blade (1), a sleeve (18) which is threaded inside and outside with reduced pitch and is screwed about the pin (20) at the upper and middle section (18*a*) thereof, while it has prismatic outside surface and cilindrical inside surface at its lower section (18*b*) in order to receive the end (20*b*) of the pin (20), said sleeve (18) being provided in the lower part with a flange (18*c*) protruding outwardly and designated to be introduced in a complementary seat (2*a*) formed in the blade (2), and within the flange (18*c*) diametrally opposed recesses are formed to receive the ends of a spring (19) pressing against the prismatic section (20*b*) of the pin (20), thus allowing the pin (20) to take on its steady position to effect the adjustment according to split turns; a sleeve (22) to adjust the maximum raising of the blade (3), said sleeve being threaded outside and being threaded inside only at its upper section while it is cylindrical at its lower section and it is fastened at its upper part to a drive head (26) and is screwed about the sleeve (18) about said sleeve (22) a ring nut (27) being screwed which is provided with locking means (27*a*, 27*b*, 27*c*) for defining the maximum raising of the blade (3) and at its lower end it is widen out in a flange (23) which is engaging the blade (3) in a recess (3*a*) thereof, within said flange (23) two recesses being provided which are diametrally opposed with respect to the axis of the means (9) and are able to connect the ends of a spring (24) pressing against the prismatic end (18*b*) of the sleeve (18), thus allowing the sleeve (22) to take on its steady position to effect the adjustment according to split turns.

5. Device according to claim 1, wherein the abuting means (28*a*, 28*b*, 28*c*) are vertical pegs fastened to the blade (1) and passing through the blades (2 and 3) in holes (29*a*, 29*b*, 29 c and 29'*a*, 29'*b*, 29'*c*) said pegs being generally transversal with respect to the blades (1, 2, 3) in order to delimitate the insertion area of the contours of the plies, sensing means being able to be secured to said pegs.

6. Device according to claim 1, wherein the means to make the insertion and the alignment of the contours of fabrics easier provides two plates (32*a*, 32*b*) mounted in seats (31*a*, 31*b*) formed in the inner surfaces of the free ends of the blades (1 and 3), said plates being shaped so as to form a peripheric slit between each other and their complementary housing seats, under said plates a chamber for the incoming compressed air channels (35*a* and 35*b*) being provided, said channels being connected to a compressed air source with the interposition of calibrating valves (36*a*, 36*b*).

7. Device according to claim 6, wherein the shaped plates (32*a* and 32*b*) can be oriented and adjusted as far as the intensity of the air jet is concerned and can be replaced with convex plates so as to provide an alignment of the ply by the air pad system, or by mechanic friction deviation system or both at the same time, the application being different from blade to blade.

8. Device according to claim 6, wherein the outside surface of the plates (32'*a*, 32'*c*), which is facing the fabric (T or t), is convex in order to engage by friction the plates over the plies to be aligned.

9. Device according to claim 1, wherein besides the assembly of abuting means (28*a*, 28*b*, 28*c*) a second assembly of abuting means is provided which are secured to the blade (2) and are passing through the blade (3) and are placed parallel to the first assembly on the free end side of the blades.

10. Device according to claim 1, wherein the middle blade (2) is provided with nozzles for ejecting compressed air through it.

11. Device according to claim 2 wherein besides the assembly of abuting means (28*a*, 28*b*, 28*c*) a second assembly of abuting means is provided which are secured to the blade (2) and are passing through the blade (3) and are placed parallel to the first assembly on the free end side of the blades.

12. Device according to claim 2 wherein the middle blade (2) is provided with nozzles for ejecting compressed air through it.

13. Device according to claim 3 wherein besides the assembly of abuting means (28*a*, 28*b*, 28*c*) a second assembly of abuting means is provided which are secured to the blade (2) and are passing through the blade (3) and are placed parallel to the first assembly on the free end side of the blades.

14. Device according to claim 3 wherein the middle blade (2) is provided with nozzles for ejecting compressed air through it.

15. Device according to claim 4 wherein besides the assembly of abuting means (28*a*, 28*b*, 28*c*) a second assembly of abuting means is provided which are secured to the blade (2) and are passing through the blade (3) and are placed parallel to the first assembly on the free end side of the blades.

16. Device according to claim 4 wherein the middle blade (2) is provided with nozzles for ejecting compressed air through it.

17. Device according to claim 5 wherein besides the assembly of abuting means (28*a*, 28*b*, 28*c*) a second assembly of abuting means is provided which are secured to the blade (2) and are passing through the blade (3) and are placed parallel to the first assembly on the free end side of the blades.

18. Device according to claim 5 wherein the middle blade (2) is provided with nozzles for ejecting compressed air through it.

19. Device according to claim 6 wherein besides the assembly of abuting means (28*a*, 28*b*, 28*c*) a second assembly of abuting means is provided which are secured to the blade (2) and are passing through the blade (3) and are placed parallel to the first assembly on the free end side of the blades.

20. Device according to claim 6 wherein the middle blade (2) is provided with nozzles for ejecting compressed air through it.

* * * * *